US009580771B2

(12) United States Patent
Ahokainen et al.

(10) Patent No.: US 9,580,771 B2
(45) Date of Patent: Feb. 28, 2017

(54) METHOD AND ARRANGEMENT FOR REFINING COPPER CONCENTRATE

(71) Applicant: Outotec (Finland) Oy, Espoo (FI)

(72) Inventors: Tapio Ahokainen, Helsinki (FI); Peter Björklund, Espoo (FI); Tuomo Jokinen, Helsinki (FI); Harri Rannikko, Helsinki (FI); Maija Metsärinta, Vanha-Ulvila (FI); Markku Lahtinen, Espoo (FI)

(73) Assignee: Outotec (Finland) Oy, Espoo (FI)

( * ) Notice: Subject to any disclaimer, the term of this patent is extended or adjusted under 35 U.S.C. 154(b) by 212 days.

(21) Appl. No.: 14/402,166

(22) PCT Filed: Jun. 12, 2013

(86) PCT No.: PCT/FI2013/050646
§ 371 (c)(1),
(2) Date: Nov. 19, 2014

(87) PCT Pub. No.: WO2013/186440
PCT Pub. Date: Dec. 19, 2013

(65) Prior Publication Data

US 2015/0143951 A1 May 28, 2015

(30) Foreign Application Priority Data

Jun. 13, 2012 (FI) ..... 20125653

(51) Int. Cl.
*F27B 19/04* (2006.01)
*C22B 15/00* (2006.01)
(Continued)

(52) U.S. Cl.
CPC ..... *C22B 15/005* (2013.01); *C22B 4/04* (2013.01); *C22B 4/08* (2013.01); *C22B 7/04* (2013.01);
(Continued)

(58) Field of Classification Search
CPC ..... C22B 15/005; C22B 15/0052; C22B 15/0047; C22B 15/0039
See application file for complete search history.

(56) References Cited

U.S. PATENT DOCUMENTS 1,698,443 A * 1/1929 Lukens ..... C22B 15/0054 75/646
4,421,552 A * 12/1983 Hoffmann ..... C22B 15/0015 75/639
(Continued)

FOREIGN PATENT DOCUMENTS

WO 9915706 A1 4/1999
WO 2008155451 A1 12/2008
(Continued)

OTHER PUBLICATIONS

Finnish search report from priority Finnish Application No. 20125653, dated Apr. 3, 2013, 1 pg.
International Search Report from corresponding PCT Application No. PCT/FI2013/050646, mailed Aug. 21, 2013, 4 pgs.
Written Opinion from corresponding PCT Application No. PCT/FI2013/050646, mailed Aug. 21, 2013, 7 pgs.
Extended European Search Report prepared by the European Patent Office for EP 13805141, Feb. 2, 2016, 3 pages.

*Primary Examiner* — George Wyszomierski
*Assistant Examiner* — Tima M McGuthry Banks
(74) *Attorney, Agent, or Firm* — Chernoff, Vilhauer, McClung & Stenzel, LLP

(57) ABSTRACT

The invention relates to a method and to an arrangement for refining copper concentrate. The arrangement includes a suspension smelting furnace comprising a reaction shaft, and a settler. The reaction shaft is provided with a concentrate burner for feeding copper concentrate such as copper sulfide concentrate and/or copper matte and additionally at least reaction gas into the reaction shaft to obtain a blister layer containing blister and a first slag layer containing slag on top of the blister layer in the settler, and a slag cleaning furnace. The arrangement includes a feeder configured for feeding blister from the blister layer in the settler and for feeding slag from the first slag layer in the settler into the slag cleaning furnace.

29 Claims, 5 Drawing Sheets

(51) Int. Cl.

| | |
|---|---|
| ***C22B 15/02*** | (2006.01) |
| ***C22B 4/04*** | (2006.01) |
| ***C22B 4/08*** | (2006.01) |
| ***C22B 7/04*** | (2006.01) |

(52) U.S. Cl.
CPC ..... *C22B 15/0032* (2013.01); *C22B 15/0039* (2013.01); *C22B 15/0047* (2013.01); *C22B 15/0052* (2013.01); *F27B 19/04* (2013.01)

(56) References Cited

U.S. PATENT DOCUMENTS

| | | | |
|---|---|---|---|
| 4,824,362 | A | 4/1989 | Kimura et al. |
| 6,042,632 | A | 3/2000 | George |
| 2005/0217422 | A1 | 10/2005 | Makinen et al. |

FOREIGN PATENT DOCUMENTS

| | | | |
|---|---|---|---|
| WO | 2009/077653 | A1 | 6/2009 |
| WO | 2009077651 | A1 | 6/2009 |

* cited by examiner

METHOD AND ARRANGEMENT FOR REFINING COPPER CONCENTRATE

CROSS-REFERENCE TO RELATED APPLICATIONS

This is a national stage application filed under 35 USC 371 based on International Application No. PCT/FI2013/050646 filed Jun. 12, 2013 and claims priority under 35 USC 119 of Finnish Patent Application No. 20125653 filed Jun. 13, 2012.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

Not Applicable.

FIELD OF THE INVENTION

The invention relates to a method for refining copper concentrate.

The invention also relates to an arrangement for refining copper concentrate.

The method includes using a suspension smelting furnace and the arrangement comprises a suspension smelting furnace. With a suspension smelting furnace is in this context meant for example a direct to blister furnace or a flash smelting furnace.

FIG. 1 show an arrangement for refining copper concentrate 1 according to the prior art. The arrangement shown in FIG. 1 comprises a suspension smelting furnace 2, a slag cleaning furnace 3 in the form of an electrical furnace, and anode furnaces 4. The suspension smelting furnace 2 comprises a reaction shaft 5, a settler 6, and an uptake 7. The reaction shaft 5 of the suspension smelting furnace 2 is provided with a concentrate burner 8 for feeding copper concentrate 1 and additionally at least reaction gas 9, and preferable also flux 10, into the reaction shaft 5 of the suspension smelting furnace 2 to obtain a blister layer 11 containing blister and a first slag layer 12 containing slag on top of the blister layer 11 in the settler 6 of the suspension smelting furnace 2. The slag cleaning furnace 3 is configured for treating slag fed from the settler 6 of the suspension smelting furnace 2 slag with a reduction agent 13 to in the slag cleaning furnace 3 obtain a bottom metal layer 14 containing bottom metal copper and a second slag layer 15 containing waste slag on top of the bottom layer 14. The arrangement shown in FIG. 1 comprises additionally slag feeding means 16 for feeding slag from the first slag layer 12 settler 6 of the suspension smelting furnace 2 into the slag cleaning furnace 3. The arrangement shown in FIG. 1 comprise additionally blister feeding means 18 for feeding blister from the blister layer 11 in the settler 6 of the suspension smelting furnace 2 to the anode furnaces 4. The arrangement shown in FIG. 1 comprises additionally bottom metal feeding means 19 for feeding bottom metal copper from bottom metal layer 14 in the slag cleaning furnace 3 to the anode furnaces 4. The arrangement shown in FIG. 1 comprises additionally waste slag discharging means 20 for discharging waste slag 21 from the slag cleaning furnace 3. The arrangement shown in FIG. 1 comprises additionally anode casting molds 17 for casting copper anodes (not shown in the figures) which can be used in an electrolytic refining process for further refining of the bottom metal copper.

One problem with a prior art arrangement as shown in FIG. 1 is that if the slag cleaning furnace 3 is cooled down or let to cool down, the bottom metal layer 14 in the slag cleaning furnace 3 will solidify. To melt the solidified bottom metal layer 14 is problem, because the thermal energy produced by the slag cleaning furnace 3 is normally only sufficient for keeping the material in the slag cleaning furnace 3 in molten state, not to melt it or at least not to melt it efficiently within a short period of time.

OBJECTIVE OF THE INVENTION

The object of the invention is to solve the above identified problem.

BRIEF SUMMARY OF THE INVENTION

The method comprises using a suspension smelting furnace comprising a reaction shaft and a settler. The reaction shaft of the suspension smelting furnace is provided with a concentrate burner for feeding copper concentrate such as copper sulfide concentrate and/or copper matte and additionally at least reaction gas into the reaction shaft of the suspension smelting furnace to obtain a blister layer containing blister and a first slag layer containing slag on top of the blister layer in the settler of the suspension smelting furnace. The method comprises using a slag cleaning furnace. The method comprises a step for feeding copper concentrate such as copper sulfide concentrate and/or copper matte and additionally at least reaction gas into the reaction shaft of the suspension smelting furnace to obtain a blister layer containing blister and a first slag layer containing slag on top of the blister layer in the settler of the suspension smelting furnace. The method comprises additionally a step for feeding slag from the first slag layer in the settler of the suspension smelting furnace and blister from the blister layer in the settler of the suspension smelting furnace from the suspension smelting furnace into the slag cleaning furnace. The method comprises additionally a step for treating blister and slag in the slag cleaning furnace with a reduction agent to obtain a bottom metal layer containing bottom metal copper and a second slag layer containing slag on top of the bottom metal layer in the slag cleaning furnace. The method comprises additionally a step for discharging bottom metal copper from the bottom metal layer in the slag cleaning furnace. The method comprises additionally a step for discharging slag from the second slag layer in the slag cleaning furnace.

The arrangement comprises a suspension smelting furnace comprising a reaction shaft and a settler. The reaction shaft of the suspension smelting furnace is provided with a concentrate burner for feeding copper concentrate such as copper sulfide concentrate and/or copper matte and additionally at least reaction gas into the reaction shaft of the suspension smelting furnace to obtain a blister layer containing blister and a first slag layer containing slag on top of the blister layer in the settler of the suspension smelting furnace. The arrangement comprises additionally feeding means for feeding blister from the blister layer in the settler of the suspension smelting furnace into the slag cleaning furnace and for feeding slag from the first slag layer in the settler of the suspension smelting furnace into the slag cleaning furnace. The slag cleaning furnace is configured for treating blister and slag in the slag cleaning furnace with a reduction agent to obtain a bottom metal layer containing bottom metal copper and a second slag layer containing slag on top of the bottom metal layer in the slag cleaning furnace. The arrangement comprises additionally bottom metal discharging means for discharging bottom metal copper from the bottom metal layer in the slag cleaning furnace. The arrangement comprises additionally slag discharging means for discharging slag from the second slag layer in the slag cleaning furnace.

The invention is based on feeding both slag and blister from the suspension smelting furnace to the slag cleaning furnace. By feeding both slag and blister from the suspension smelting furnace to the slag cleaning furnace will a greater amount of thermal energy be fed to the slag cleaning furnace in comparison to a situation where only slag is fed from the suspension smelting furnace to the slag cleaning furnace, as in the prior art arrangement shown in FIG. 1. This greater amount of thermal energy can be used for melting material possible having been solidified in the slag cleaning furnace. Because both slag and blister from the suspension smelting furnace to the slag cleaning furnace, a slag storage in the settler of the suspension smelting furnace is unnecessarily. Additionally it is unnecessary to separate blister from slag in the settler, because both slag and blister are fed from the suspension smelting furnace to the slag cleaning furnace. Because of this, the settler may be made smaller, which reduces the costs for the suspension smelting furnace. If blister and slag are tapped directly into the slag cleaning furnace with very low bath level in the flash, then foaming potential will be low. The suspension smelting furnaces can be run with lower oxygen potential, as the foaming tendency will be lower. This means lower off-gas volumes and savings in operational costs in the off-gas line. Also less reducing work for the slag cleaning furnace, and therefore less energy consumption In a preferred embodiment of the method, the method comprises feeding copper concentrate such as copper sulfide concentrate and/or copper matte and/or reaction gas into the reaction shaft of the suspension smelting furnace so that the temperature of the blister fed from the blister layer in settler of the suspension smelting furnace is between 1250 and 1400° C.

In a preferred embodiment of the method, the method comprises preferably, but not necessarily, feeding copper concentrate such as copper sulfide concentrate and/or copper matte and/or reaction gas into the reaction shaft of the suspension smelting furnace so that the temperature of the slag fed from the first slag layer in the settler of the suspension smelting furnace is between 1250 and 1400° C.

In a preferred embodiment of the method, the method comprises feeding copper concentrate such as copper sulfide concentrate and/or copper matte and/or reaction gas into the reaction shaft of the suspension smelting furnace so that the temperature of the blister fed from the blister layer in the settler of the suspension smelting furnace is between 1250 and 1400° C. and so that the temperature of the slag fed from the first slag layer in the settler of the suspension smelting furnace is between 1250 and 1400° C. Sometimes there is too much heat in the suspension smelting furnace and so off gas volume becomes large. This may be even be even beneficiancy now, because operating temperature can be set higher as the melt will be laundered into the slag cleaning furnace, where high heat poses no problems. The off-gas volume can be lower than normally as suspension smelting furnaces can be run hotter, which means lower off-gas volumes Feeding blister and/or slag having temperature between 1250 and 1400° C. from the settler of the suspension smelting furnace reduces the need for thermal energy to be fed to the slag cleaning furnace for the reduction process, because the blister and/or the slag that is fed to the suspension smelting furnace is over hot i.e. contains excess thermal energy in addition to that needed for the reaction in the suspension smelting furnace. This excess thermal energy can be used in the reduction process in the slag cleaning furnace. Especially if an electric furnace is used as a slag cleaning furnace, this is particularly advantageous, because it is less expensive to create thermal energy by a suspension smelting furnace than to create thermal energy with an electric furnace.

The method comprises preferably, but not necessarily, feeding blister from the blister layer in the settler of the suspension smelting furnace into the slag cleaning furnace without refining the blister fed from the blister layer in the settler of the suspension smelting furnace prior feeding the blister fed from the blister layer in the settler of the suspension smelting furnace into the slag cleaning furnace.

The blister feeding means for feeding blister from the blister layer in the settler of the suspension smelting furnace into the slag cleaning furnace are preferably, but not necessarily, configured for feeding blister from the blister layer in the settler of the suspension smelting furnace into the slag cleaning furnace without refining the blister fed from the blister layer in the settler of the suspension smelting furnace prior feeding the blister fed from the blister layer in the settler of the suspension smelting furnace into the slag cleaning furnace.

Another advantage achievable with the method and the arrangement according to the invention is that it makes possible a simplified layout in comparison with the prior art method and arrangement shown in FIG. 1. For example in the embodiments shown in FIG. 2, which comprises anode furnaces, material is only fed into the slag cleaning furnace from the suspension smelting furnace and material is only fed into the anode furnaces from the slag cleaning furnace.

BRIEF DESCRIPTION OF THE SEVERAL VIEWS OF THE DRAWINGS

In the following the invention will described in more detail by referring to the figures, which

DETAILED DESCRIPTION OF THE INVENTION

Figure 1:
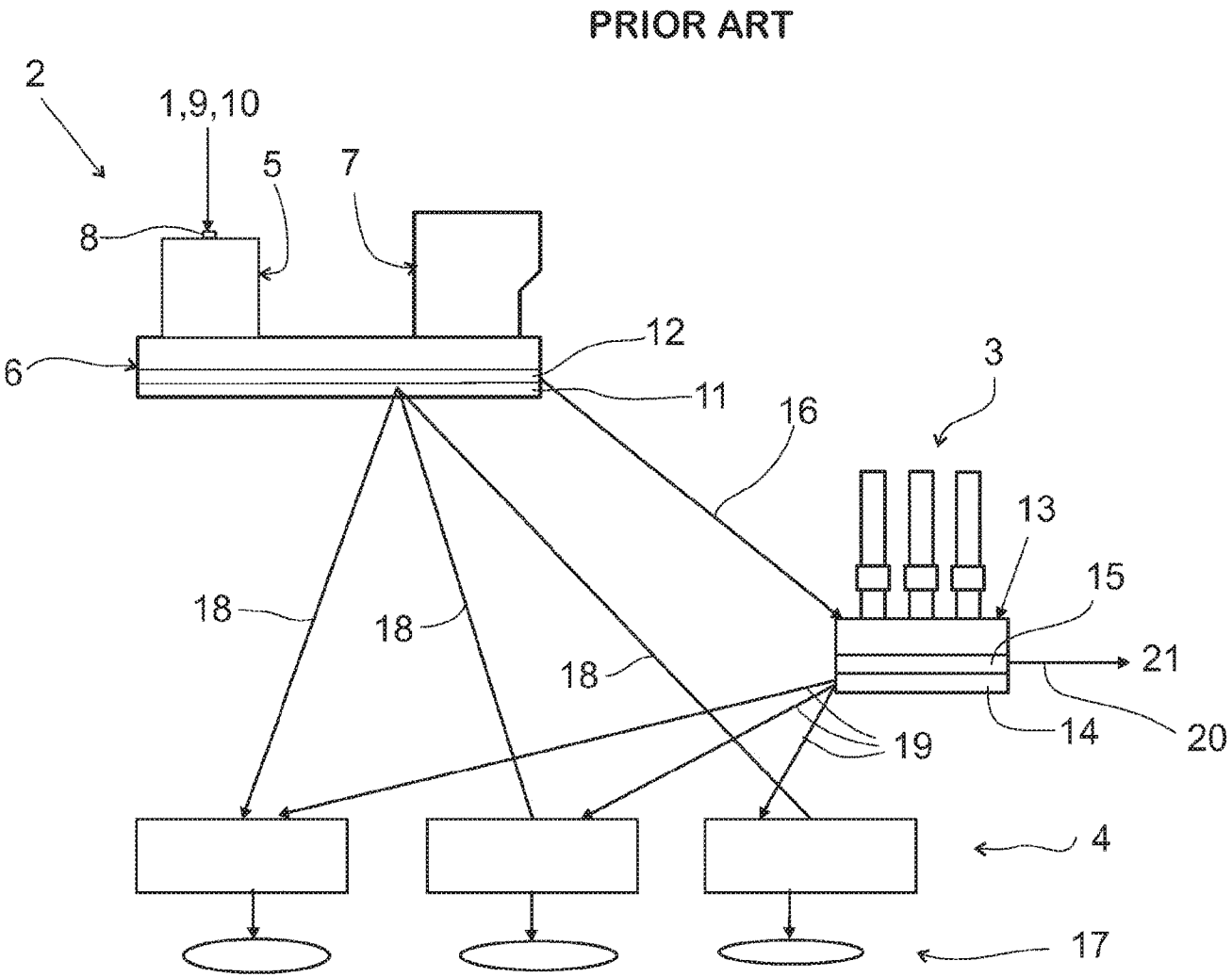
FIG. 1 shows an arrangement to the prior art.

The invention relates to a method and to an arrangement for refining copper concentrate 1.

First the method refining copper concentrate 1 and preferred embodiments and variants thereof will be described in greater detail.

The method comprises using a suspension smelting furnace 2 comprising a reaction shaft 5, a settler 6, and preferably, but not necessarily, an uptake 7.

The reaction shaft 5 of the suspension smelting furnace 2 is provided with a concentrate burner 8 for feeding copper concentrate 1 such as copper sulfide concentrate and/or copper matte and additionally at least reaction gas 9, and preferable also flux 10, into the reaction shaft 5 of the suspension smelting furnace 2 to obtain a blister layer 11 containing blister and a first slag layer 12 containing slag on top of the blister layer 11 in the settler 6 of the suspension smelting furnace 2.

The method comprises additionally using a slag cleaning furnace 3. The method comprises preferably using an electric furnace as the slag cleaning furnace 3.

The method comprises a step for feeding copper concentrate 1 such as copper sulfide concentrate and/or copper matte and additionally at least reaction gas 9, and preferable also flux 10, into the reaction shaft 5 of the suspension smelting furnace 2 to obtain a blister layer 11 containing blister and a first slag layer 12 containing slag on top of the blister layer 11 in the settler 6 of the suspension smelting furnace 2.

The method comprises additionally a step for feeding slag from the first slag layer 12 in the settler 6 of the suspension smelting furnace 2 into the slag cleaning furnace 3 and for feeding blister from blister layer 11 in the settler 6 of the suspension smelting furnace 2 into the slag cleaning furnace 3.

The method comprises additionally a step for treating blister and slag in the slag cleaning furnace 3 with a reduction agent 16 such as coke to obtain a bottom metal layer 14 containing bottom metal copper and a second slag layer 15 containing slag on top of the bottom metal layer 14 in the slag cleaning furnace 3. In this step copper present in the slag fed from the first slag layer 12 in the suspension smelting furnace 2 moves from the second slag layer 15 to the bottom metal layer 14. The method comprises additionally a step for discharging bottom metal copper from the bottom metal layer 14 in the slag cleaning furnace 3.

The method comprises additionally a step for discharging slag 21 from the second slag layer 15 in the slag cleaning furnace 3.

Figure 2:
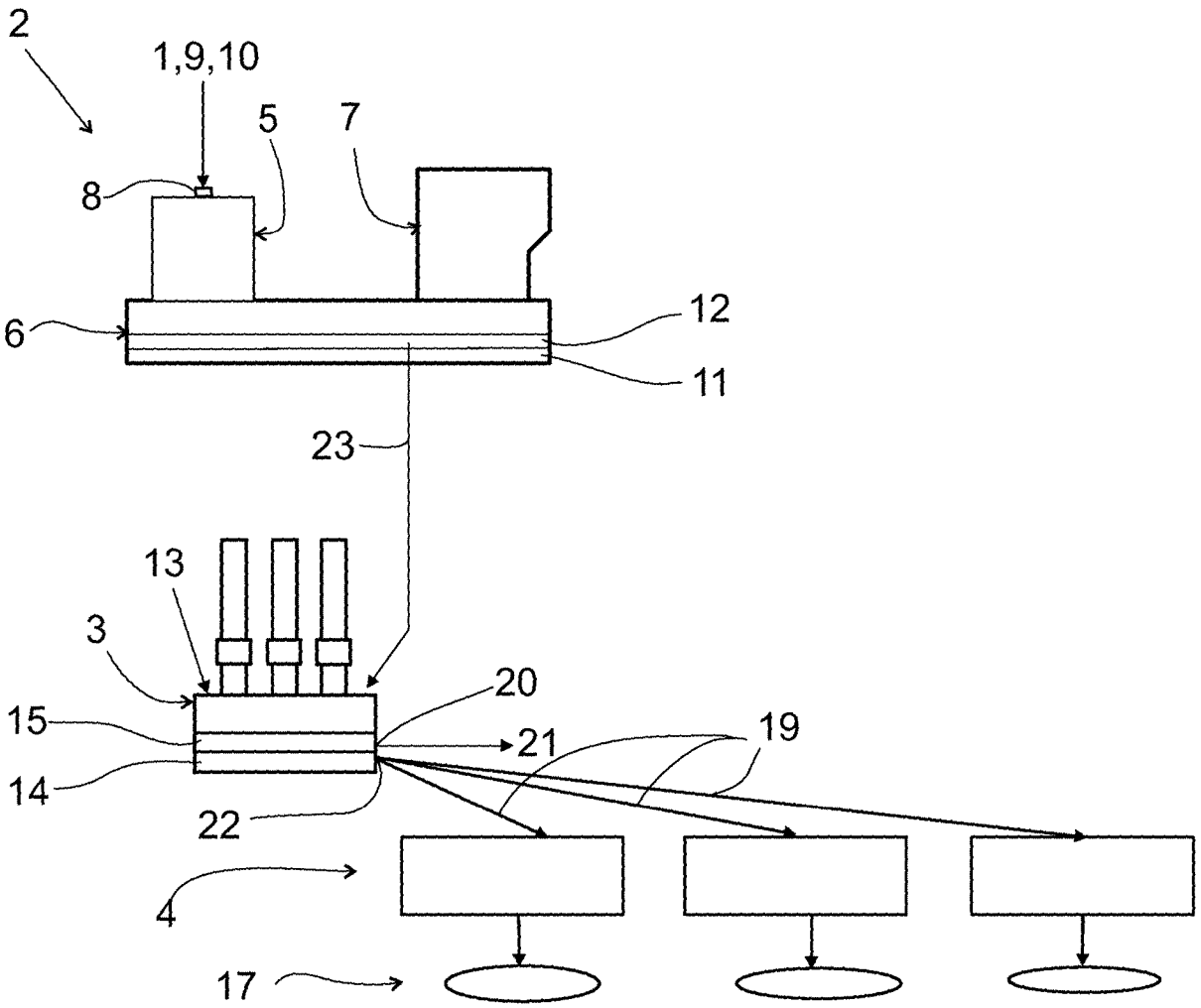
FIG. 2 shows a first embodiment of the arrangement.
Figure 3:
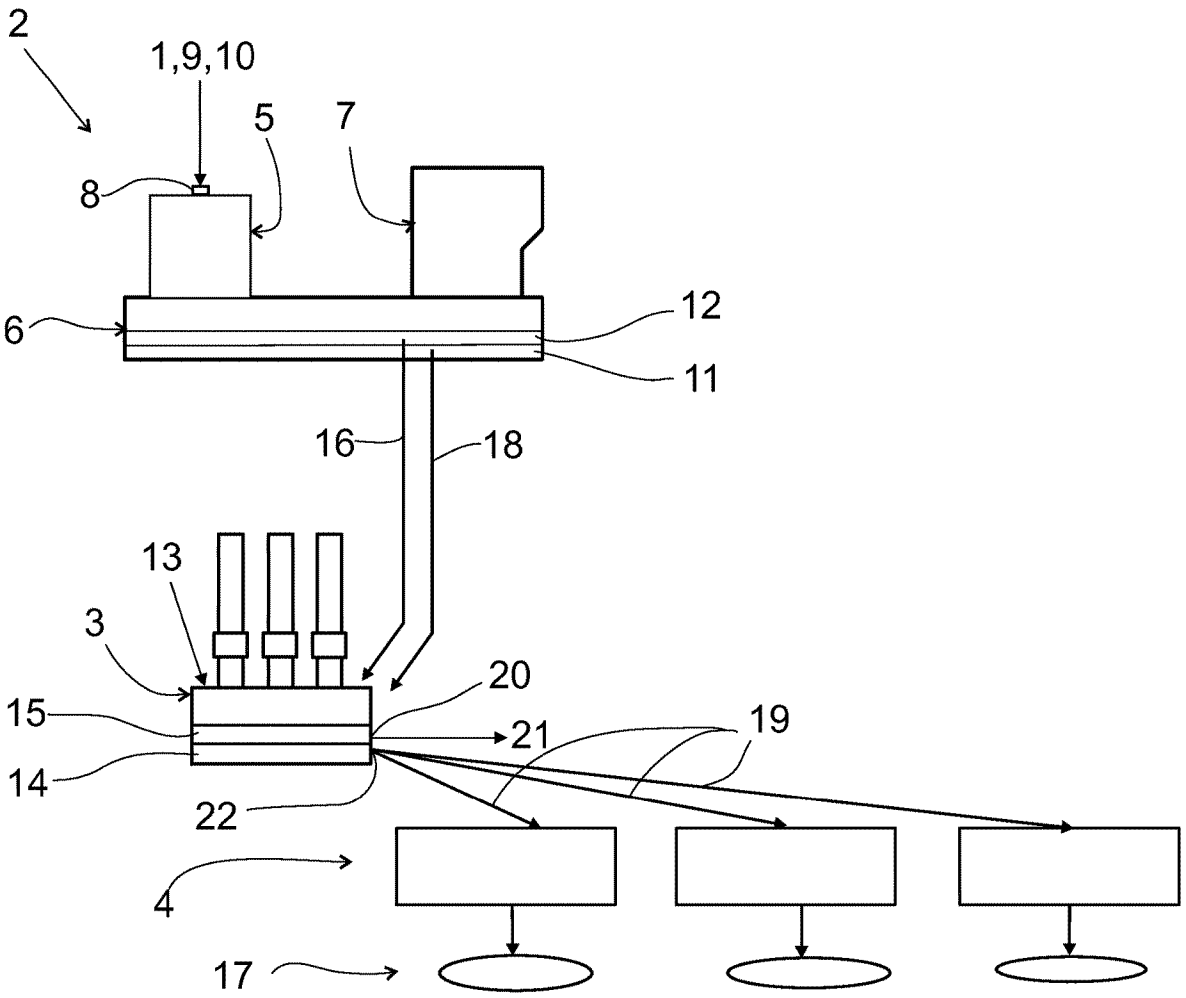
FIG. 3 shows a second embodiment of the arrangement.
Figure 4:
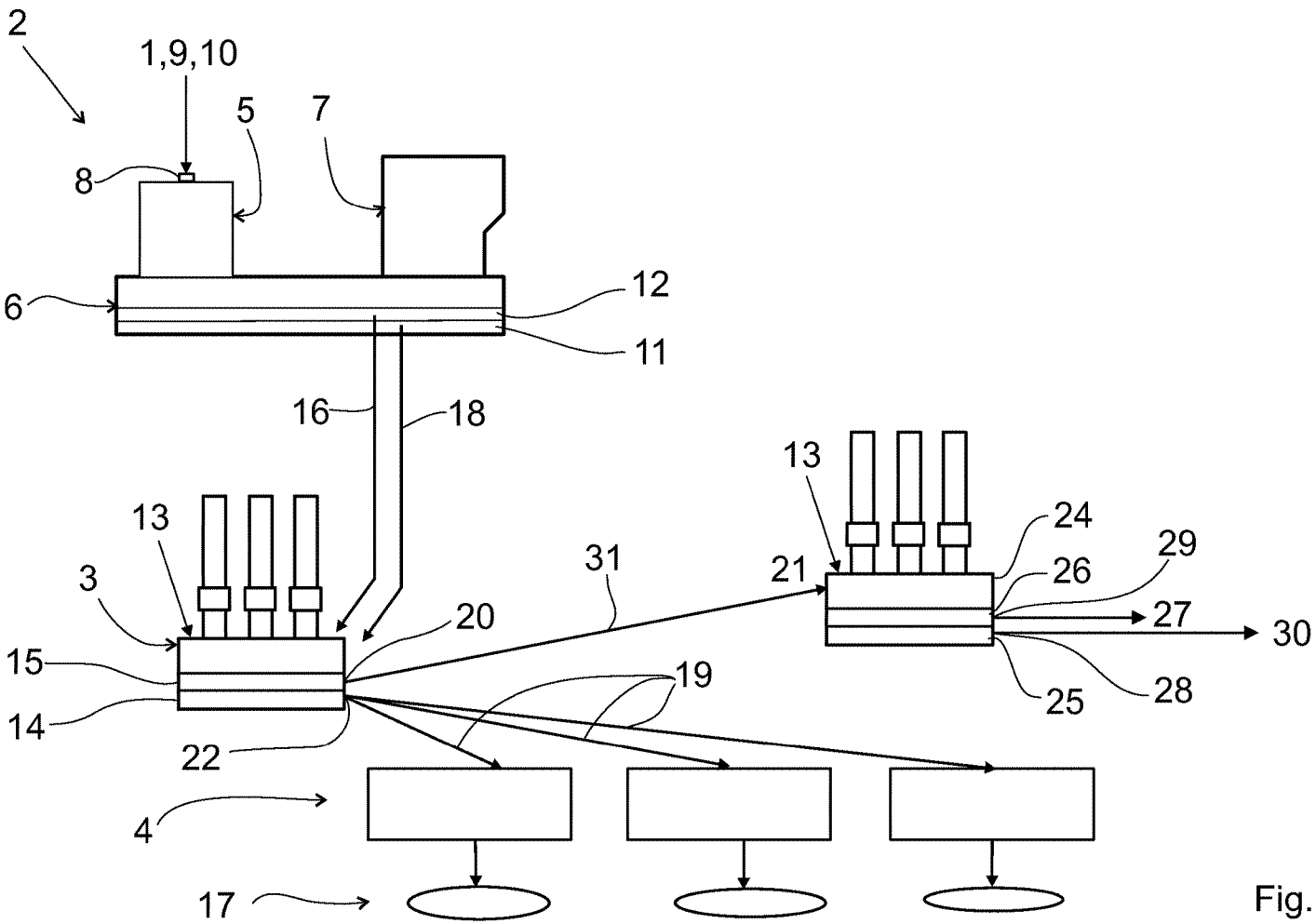
FIG. 4 shows a third embodiment of the arrangement.
Figure 5:
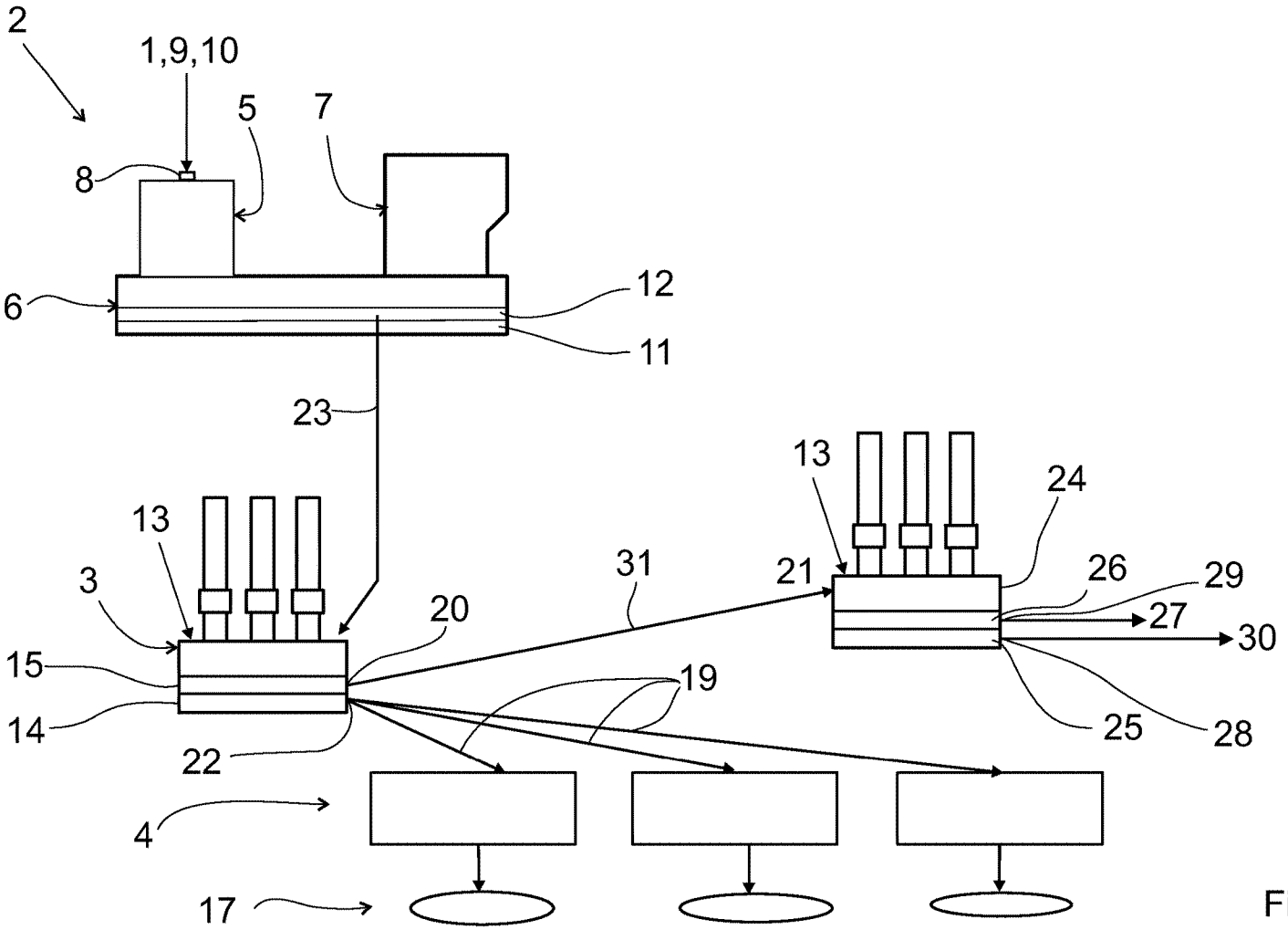
FIG. 5 shows a fourth embodiment of the arrangement.

In the method slag from the first slag layer 12 in the settler 6 of the suspension smelting furnace 2 and blister from the blister layer 11 in the settler 6 of the suspension smelting furnace 2 may be fed together from the suspension smelting furnace 2 into the slag cleaning furnace 3, as shown in FIGS. 2 and 5. Alternatively, slag from the first slag layer 12 in the settler 6 of the suspension smelting furnace 2 and blister from the blister layer 11 in the settler 6 of the suspension smelting furnace 2 may be fed separately from the suspension smelting furnace 2 into the slag cleaning furnace 3 as shown in FIGS. 3 and 4.

In the method, slag from the first slag layer 12 in the settler 6 of the suspension smelting furnace 2 and/or blister from the blister layer 11 in the settler 6 of the suspension smelting furnace 2 from the suspension smelting furnace 2 may be fed in batches into the slag cleaning furnace 3. Alternatively, slag from the first slag layer 12 in the settler 6 of the suspension smelting furnace 2 and/or blister from the blister layer 11 in the settler 6 of the suspension smelting furnace 2 from the suspension smelting furnace 2 may be fed continuously into the slag cleaning furnace 3. By using continuous feeding, feeding means 16, 18, 23 for feeding blister from the blister layer 12 in the settler 6 of the suspension smelting furnace 2 and for feeding slag from the first slag layer 12 in the settler 6 of the suspension smelting furnace 2 into the slag cleaning furnace 3 are easier to keep open.

The method comprises preferably, but not necessarily, a step for feeding bottom metal copper discharged from the bottom metal layer 14 in the slag cleaning furnace 3 to an anode furnace 4.

The method comprises preferably, but not necessarily, feeding copper concentrate 1 such as copper sulfide concentrate and/or copper matte and/or reaction gas 9 into the reaction shaft 5 of the suspension smelting furnace 2 so that the temperature of the blister fed from the blister layer 11 in the settler 6 of the suspension smelting furnace 2 is between 1250 and 1400° C.

The method comprises preferably, but not necessarily, feeding copper concentrate 1 such as copper sulfide concentrate and/or copper matte and/or reaction gas 9 into the reaction shaft 5 of the suspension smelting furnace 2 so that the temperature of the slag fed from the first slag layer 12 in the settler 6 of the suspension smelting furnace 2 is between 1250 and 1400° C.

The method comprises preferably, but not necessarily, feeding inert gas or inert gas mixture into the slag cleaning furnace.

The method comprises preferably, but not necessarily, feeding blister from the blister layer 11 in the settler 6 of the suspension smelting furnace 2 into the slag cleaning furnace 3 without refining the blister fed from the blister layer 11 in the settler 6 of the suspension smelting furnace 2 prior feeding the blister fed from the blister layer 11 in the settler 6 of the suspension smelting furnace 2 into the slag cleaning furnace 3.

The method may in some embodiments, as shown in FIGS. 4 and 5, include using an additional slag cleaning furnace 24 in addition to the slag cleaning furnace 3. These embodiments of the method includes a step for feeding slag 21 from the slag cleaning furnace 3 into the additional slag cleaning furnace 24 and a step for treating slag 21 in the additional slag cleaning furnace 24 with a reduction agent 13 to obtain a bottom alloy layer 25 containing bottom alloy 30 and a waste slag layer 26 containing waste slag 27. These embodiments of the method includes a step for discharging bottom alloy 30 from the bottom alloy layer 25 in the additional slag cleaning furnace 24, and a step for discharging waste slag 27 from the waste slag layer 26 in the additional slag cleaning furnace 24. An electric furnace may be used as the additional slag cleaning furnace 24.

Next the arrangement for refining copper concentrate 1 and preferred embodiments and variants thereof will be described in greater detail.

The arrangement comprises a suspension smelting furnace 2 comprising a reaction shaft 5, a settler 6, and preferably, but not necessarily, an uptake 7.

The reaction shaft 5 of the suspension smelting furnace 2 is provided with a concentrate burner 8 for feeding copper concentrate 1 such as copper sulfide concentrate and/or copper matte and additionally at least reaction gas 9 and preferably also flux 11 into the reaction shaft 5 of the suspension smelting furnace 2 to obtain a blister layer 11 containing blister and a first slag layer 12 containing slag on top of the blister layer 11 in the settler 6 of the suspension smelting furnace 2.

The arrangement comprises additionally a slag cleaning furnace 3, which preferably, but not necessarily, is in the form of an electric furnace.

The arrangement comprises additionally feeding means 16, 18, 23 for feeding blister from the blister layer 12 in the settler 6 of the suspension smelting furnace 2 and for feeding slag from the first slag layer 12 in the settler 6 of the suspension smelting furnace 2 into the slag cleaning furnace 3.

The slag cleaning furnace 3 is configured for treating blister and slag in the slag cleaning furnace 3 with a reduction agent 13 to obtain a bottom metal layer 14 containing bottom metal copper and a second slag layer 15 containing slag 21 on top of the bottom metal layer 14 in the slag cleaning furnace 3. In the slag cleaning furnace 3 copper present in the slag fed from the first slag layer 12 in the suspension smelting furnace 2 moves from the second slag layer 15 to the bottom metal layer 14.

The arrangement comprises additionally bottom metal discharging means 22 for discharging bottom metal copper from the bottom metal layer 14 in the slag cleaning furnace 3.

The arrangement comprises additionally slag discharging means 20 for discharging slag 21 from the second slag layer 15 in the slag cleaning furnace 3. The feeding means 18, 19, 23 for feeding blister from the blister layer 11 in the settler 6 of the suspension smelting furnace 2 and for feeding slag from the first slag layer 12 in the settler 6 of the suspension smelting furnace 2 from the suspension smelting furnace 3 into the slag cleaning furnace 3 may, as shown in FIGS. 3 and 4 include a separate first slag feeding means 16 for feeding separately slag from the first slag layer 12 in the settler 6 of the suspension smelting furnace 2 from the suspension smelting furnace 3 into the slag cleaning furnace 3. Such separate first slag feeding means 16 for feeding slag from the first slag layer 12 in the settler 6 of the suspension smelting furnace 2 into the slag cleaning furnace 3 may be configured for feeding slag from the first slag layer 12 in the settler 6 of the suspension smelting furnace 2 into the slag cleaning furnace 3 without refining the slag prior feeding the slag into the slag cleaning furnace 3.

The feeding means 18, 19, 23 for feeding blister from the blister layer 11 in the settler 6 of the suspension smelting furnace 2 and for feeding slag from the first slag layer 12 in the settler 6 of the suspension smelting furnace 2 from the suspension smelting furnace 3 into the slag cleaning furnace 3 may, as shown in FIGS. 3 and 4, include a separate blister feeding means 18 for feeding separately blister from the blister layer 11 in the settler 6 of the suspension smelting furnace 2 from the suspension smelting furnace 3 into the slag cleaning furnace 3. Such separate blister feeding means 18 for feeding blister from the blister layer 11 in the settler 6 of the suspension smelting furnace 2 into the slag cleaning furnace 3 may be configured for feeding blister from the blister layer 11 in the settler 6 of the suspension smelting furnace 2 into the slag cleaning furnace 3 without refining the blister prior feeding the blister into the slag cleaning furnace 3.

The feeding means 18, 19, 23 for feeding blister from the blister layer 11 in the settler 6 of the suspension smelting furnace 2 and for feeding slag from the first slag layer 12 in the settler 6 of the suspension smelting furnace 2 from the suspension smelting furnace 3 into the slag cleaning furnace 3 may, as shown in FIGS. 2 and 5, include a combined slag and blister feeding means 23 for feeding slag from the first slag layer 12 in the settler 6 of the suspension smelting furnace 2 from the suspension smelting furnace 3 together with blister from the blister layer 11 in the settler 6 of the suspension smelting furnace 2 from the suspension smelting furnace 3 into the slag cleaning furnace 3. Such combined slag and blister feeding means 23 for feeding slag from the first slag layer 12 in the settler 6 of the suspension smelting furnace 2 from the suspension smelting furnace 3 together with blister from the blister layer 11 in the settler 6 of the suspension smelting furnace 2 from the suspension smelting furnace 3 into the slag cleaning furnace 3 may be configured for feeding slag from the first slag layer 12 in the settler 6 of the suspension smelting furnace 2 from the suspension smelting furnace 3 together with blister from the blister layer 11 in the settler 6 of the suspension smelting furnace 2 from the suspension smelting furnace 3 into the slag cleaning furnace 3 without refining the slag and the blister prior feeding the slag and the blister into the slag cleaning furnace 3.

The feeding means 16, 18, 23 may be configured for feeding slag from the first slag layer 12 in the settler 6 of the suspension smelting furnace 2 and/or blister from the blister layer 11 in the settler 6 of the suspension smelting furnace 2 from the suspension smelting furnace 2 in batches into the slag cleaning furnace 3. Alternatively, the feeding means 16, 18, 23 may be configured for feeding slag from the first slag layer 12 in the settler 6 of the suspension smelting furnace 2 and/or blister from the blister layer 11 in the settler 6 of the suspension smelting furnace 2 from the suspension smelting furnace 2 continuously into the slag cleaning furnace 3.

The bottom metal discharging means 22 for discharging bottom metal copper from the bottom metal layer 14 in the slag cleaning furnace 3 is preferably, but not necessarily as shown in FIGS. 2 to 5, connected with bottom metal feeding means 19 for feeding bottom metal copper to an anode furnace 4.

The arrangements shown in FIGS. 2 to 5 comprises additionally anode casting molds 17 for casting copper anodes which can be used in an electrolytic refining process for further reefing of the copper.

The blister feeding means 18 for feeding blister from the blister layer 11 in the settler 6 of the suspension smelting furnace 2 into the slag cleaning furnace 3 are preferably, but not necessarily, configured for feeding blister from the blister layer 11 in the settler 6 of the suspension smelting furnace 2 into the slag cleaning furnace 3 without refining the blister fed from the blister layer 11 in the settler 6 of the suspension smelting furnace 2 prior feeding the blister fed from the blister layer 11 in the settler 6 of the suspension smelting furnace 2 into the slag cleaning furnace 3.

The arrangement may comprise by gas feeding means for feeding inert gas or inert gas mixture into the slag cleaning furnace 3.

The arrangement may in some embodiments, as shown in FIGS. 4 and 5, comprise an additional slag cleaning furnace 24 in addition to the slag cleaning furnace 3 and second slag feeding means 31 for feeding slag 21 from the slag cleaning furnace 3 into the additional slag cleaning furnace 24 to reduce the copper content in the slag and to recover copper. In such embodiments, the additional slag cleaning furnace 24 is configured for treating slag 21 in the additional slag cleaning furnace 24 with a reduction agent 13 to obtain a bottom alloy layer 25 containing bottom alloy 30 and a waste slag layer 26 containing waste slag 27. In such embodiments, the arrangement comprises additional bottom metal discharging means 28 for discharging bottom alloy 30 from the bottom alloy layer 25 in the additional slag cleaning furnace 24, and additional waste slag discharging means 29 for discharging waste slag 27 from the waste slag layer 26 in the additional slag cleaning furnace 24. The additional slag cleaning furnace 24 may be an electrical furnace.

It is apparent to a person skilled in the art that as technology advanced, the basic idea of the invention can be implemented in various ways. The invention and its embodiments are therefore not restricted to the above examples, but they may vary within the scope of the claims.

SEQUENCE LISTING

Not Applicable.

The invention claimed is:

1. A method for refining copper concentrate, wherein the method comprises using a suspension smelting furnace comprising a reaction shaft, and a settler, wherein the reaction shaft of the suspension smelting furnace is provided with a concentrate burner for feeding copper concentrate and additionally at least reaction gas into the reaction shaft of the suspension smelting furnace to obtain a blister layer containing blister and a first slag layer containing slag on top of the blister layer in the settler of the suspension smelting furnace, and using a slag cleaning furnace, and feeding copper concentrate and additionally at least reaction gas into the reaction shaft of the suspension smelting furnace to obtain a blister layer containing blister and a first slag layer containing slag on top of the blister layer in the settler of the suspension smelting furnace, and wherein the method comprises feeding slag from the first slag layer in the settler of the suspension smelting furnace and blister from the blister layer in the settler of the suspension smelting furnace from the suspension smelting furnace into the slag cleaning furnace, treating blister and slag in the slag cleaning furnace with a reduction agent to obtain a bottom metal layer containing bottom metal copper and a second slag layer containing slag on top of the bottom metal layer in the slag cleaning furnace, discharging bottom metal copper from the bottom metal layer in the slag cleaning furnace, and discharging slag from the second slag layer in the slag cleaning furnace.

2. The method according to claim 1, comprising feeding slag from the first slag layer in the settler of the suspension smelting furnace and blister from the blister layer in the settler of the suspension smelting furnace together from the suspension smelting furnace into the slag cleaning furnace.

3. The method according to claim 1, comprising feeding slag from the first slag layer in the settler of the suspension smelting furnace and blister from the blister layer in the settler of the suspension smelting furnace separately from the suspension smelting furnace into the slag cleaning furnace.

4. The method according to claim 1, comprising feeding slag from the first slag layer in the settler of the suspension smelting furnace and/or blister from the blister layer in the settler of the suspension smelting furnace from the suspension smelting furnace in batches into the slag cleaning furnace.

5. The method according to claim 1, comprising feeding slag from the first slag layer in the settler of the suspension smelting furnace and/or blister from the blister layer in the settler of the suspension smelting furnace from the suspension smelting furnace continuously into the slag cleaning furnace.

6. The method according to claim 1, comprising feeding bottom metal copper discharged from the bottom metal layer in the slag cleaning furnace to an anode furnace.

7. The method according to claim 1, comprising using an electric furnace as the slag cleaning furnace.

8. The method according to claim 1, comprising feeding copper concentrate and/or reaction gas into the reaction shaft so that the temperature of the blister fed from the blister layer in the settler of the suspension smelting furnace is between 1250 and 1400° C.

9. The method according to claim 1, comprising feeding copper concentrate and/or reaction gas into the reaction shaft so that the temperature of the slag fed from the first slag layer in the settler of the suspension smelting furnace is between 1250 and 1400° C.

10. The method according to claim 1, comprising feeding inert gas or inert gas mixture into the slag cleaning furnace.

11. The method according to claim 1, comprising feeding blister from blister layer in the settler of the suspension smelting furnace into the slag cleaning furnace without refining the blister fed from the blister layer in the settler of the suspension smelting furnace prior feeding the blister fed from the blister layer in the settler of the suspension smelting furnace into the slag cleaning furnace.

12. The method according to claim 1, comprising using an additional slag cleaning furnace in addition to the slag cleaning furnace, feeding slag from the slag cleaning furnace into the additional slag cleaning furnace, treating slag in the additional slag cleaning furnace with a reduction agent to obtain a bottom alloy layer containing bottom alloy and a waste slag layer containing waste slag, discharging bottom alloy from the bottom alloy layer in the additional slag cleaning furnace, and discharging waste slag from the waste slag layer in the additional slag cleaning furnace.

13. The method according to claim 12, comprising using an electric furnace as the additional slag cleaning furnace.

14. The method according to claim 1, wherein the copper concentrate being copper sulfide concentrate and/or copper matte.

15. An arrangement for refining copper concentrate, wherein the arrangement comprises a suspension smelting furnace comprising a reaction shaft, and a settle, wherein the reaction shaft of the suspension smelting furnace is provided with a concentrate burner for feeding copper concentrate and additionally at least reaction gas into the reaction shaft of the suspension smelting furnace to obtain a blister layer containing blister and a first slag layer containing slag on top of the blister layer in the settler of the suspension smelting furnace, and a slag cleaning furnace, wherein the arrangement comprises a feeder being configured for feeding blister from the blister layer in the settler of the suspension smelting furnace and configured for feeding slag from the first slag layer in the settler of the suspension smelting furnace from the suspension smelting furnace into the slag cleaning furnace, wherein the slag cleaning furnace being configured for treating blister and slag in the slag cleaning furnace with a reduction agent to obtain a bottom metal layer containing bottom metal copper and a second slag layer containing slag on top of the bottom metal layer in the slag cleaning furnace, wherein the arrangement comprises a bottom metal discharger configured for discharging bottom metal copper from the bottom metal layer in the slag cleaning furnace, and wherein the arrangement comprises a slag discharger configured for discharging slag from the second slag layer in the slag cleaning furnace.

16. The arrangement according to claim 15, wherein the feeder configured for feeding blister from the blister layer in the settler of the suspension smelting furnace and configured for feeding slag from the first slag layer in the settler of the suspension smelting furnace from the suspension smelting furnace into the slag cleaning furnace includes a separate first slag feeder configured for feeding separately slag from the first slag layer in the settler of the suspension smelting furnace from the suspension smelting furnace into the slag cleaning furnace.

17. The arrangement according to claim 16, wherein the separate first slag feeder configured for feeding slag from the first slag layer in the settler of the suspension smelting furnace into the slag cleaning furnace is configured for feeding slag from the first slag layer in the settler of the suspension smelting furnace into the slag cleaning furnace without refining the slag prior feeding the slag into the slag cleaning furnace.

18. The arrangement according to claim 15, wherein the feeder configured for feeding blister from the blister layer in the settler of the suspension smelting furnace and configured for feeding slag from the first slag layer in the settler of the suspension smelting furnace from the suspension smelting furnace into the slag cleaning furnace includes a separate feeder configured for feeding separately blister from the blister layer in the settler of the suspension smelting furnace from the suspension smelting furnace into the slag cleaning furnace.

19. The arrangement according to claim 18, wherein the separate blister feeder configured for feeding blister from the blister layer in the settler of the suspension smelting furnace into the slag cleaning furnace is configured for feeding blister from the blister layer in the settler of the suspension smelting furnace into the slag cleaning furnace without refining the blister prior feeding the blister into the slag cleaning furnace.

20. The arrangement according to claim 15, wherein the feeder configured for feeding blister from the blister layer in the settler of the suspension smelting furnace and configured for feeding slag from the first slag layer in the settler of the suspension smelting furnace from the suspension smelting furnace into the slag cleaning furnace includes a combined slag and blister feeder configured for feeding slag from the first slag layer in the settler of the suspension smelting furnace from the suspension smelting furnace together with blister from the blister layer in the settler of the suspension smelting furnace from the suspension smelting furnace into the slag cleaning furnace.

21. The arrangement according to claim 20, wherein the combined slag and blister feeder configured for feeding slag from the first slag layer in the settler of the suspension smelting furnace from the suspension smelting furnace together with blister from the blister layer in the settler of the suspension smelting furnace from the suspension smelting furnace into the slag cleaning furnace is configured for feeding slag from the first slag layer in the settler of the suspension smelting furnace from the suspension smelting furnace together with blister from the blister layer in the settler of the suspension smelting furnace from the suspension smelting furnace into the slag cleaning furnace without refining the slag and the blister prior feeding the slag and the blister into the slag cleaning furnace.

22. The arrangement according to claim 15 wherein the feeder being configured for feeding slag from the first slag layer in the settler of the suspension smelting furnace and/or blister from the blister layer in the settler of the suspension smelting furnace from the suspension smelting furnace in batches into the slag cleaning furnace.

23. The arrangement according to claim 15, wherein the feeder being configured for feeding slag from the first slag layer in the settler of the suspension smelting furnace and/or blister from the blister layer in the settler of the suspension smelting furnace from the suspension smelting furnace continuously into the slag cleaning furnace.

24. The arrangement according to claim 15, wherein the bottom metal discharger configured for discharging bottom metal copper from the bottom metal layer in the slag cleaning furnace being connected with a bottom metal feeder configured for feeding bottom metal copper to an anode furnace.

25. The arrangement according to claim 15, wherein the slag cleaning furnace is an electrical cleaning furnace.

26. The arrangement according to claim 15, comprising gas feeder configured for feeding inert gas or inert gas mixture into the slag cleaning furnace.

27. The arrangement according to claim 15, comprising an additional slag cleaning furnace in addition to the slag cleaning furnace, and comprising a second slag feeder configured for feeding slag from the slag cleaning furnace into the additional slag cleaning furnace, wherein the additional slag cleaning furnace being configured for treating slag in the additional slag cleaning furnace with a reduction agent to obtain a bottom alloy layer containing bottom alloy and a waste slag layer containing waste slag, comprising an additional bottom metal discharger configured for discharging bottom alloy from the bottom alloy layer in the additional slag cleaning furnace, and comprising an additional waste slag discharger configured for discharging waste slag from the waste slag layer in the additional slag cleaning furnace.

28. The arrangement according to claim 27, wherein the additional slag cleaning furnace being an electric furnace.

29. The arrangement according to claim 15, wherein the copper concentrate being copper sulfide concentrate and/or copper matte.

* * * * *